US006408720B2

(12) United States Patent
Collins et al.

(10) Patent No.: US 6,408,720 B2
(45) Date of Patent: Jun. 25, 2002

(54) OFFSET HYDRAULIC RUNNER APPARATUS

(76) Inventors: Bobby W. Collins, 825 Holiday Ct., Kenner, LA (US) 70065; Robert Decker, 1509 Carroll St., Kenner, LA (US) 70062; Don Clover, 4903 Waterbeck Dr., Fulshear, TX (US) 77441; Michael Shirey, 4819 Baudin St., New Orleans, LA (US) 70119

( * ) Notice: Subject to any disclaimer, the term of this patent is extended or adjusted under 35 U.S.C. 154(b) by 0 days.

(21) Appl. No.: 09/728,528

(22) Filed: Dec. 1, 2000

Related U.S. Application Data

(63) Continuation-in-part of application No. 09/302,836, filed on Apr. 30, 1999, now abandoned.

(51) Int. Cl.[7] ..... B25B 21/00
(52) U.S. Cl. ..... 81/57.39; 81/57.13
(58) Field of Search ..... 81/57.13, 57.14, 81/57.2, 57.29, 57.3, 57.31, 57.39

(56) References Cited

U.S. PATENT DOCUMENTS

| | | | | |
|---|---|---|---|---|
| 418,337 A | | 12/1889 | Kors | |
| 1,534,334 A | | 4/1925 | Stutsman | |
| 1,950,704 A | | 3/1934 | Thomson | |
| 2,242,954 A | | 5/1941 | Ingwer | |
| 2,429,929 A | | 10/1947 | Fisher | |
| 2,517,062 A | | 8/1950 | Vosper | |
| 2,615,682 A | | 12/1952 | Stone | |
| 2,634,518 A | | 4/1953 | Merz | |
| 2,712,256 A | | 7/1955 | Fish | |
| 2,837,177 A | | 6/1958 | Edge et al. | |
| 2,855,613 A | | 10/1958 | Kostka | |
| 3,031,699 A | | 5/1962 | Fleury | |
| 3,683,686 A | | 8/1972 | Sergan | |
| 3,706,244 A | | 12/1972 | Wilmeth | |
| 3,745,858 A | | 7/1973 | Biach | |
| 3,930,776 A | | 1/1976 | Keller | |
| 3,939,924 A | * | 2/1976 | Grabovac | 173/163 |
| 3,995,828 A | | 12/1976 | Orban | |
| 4,027,560 A | | 6/1977 | Parker | |
| 4,027,561 A | | 6/1977 | Junkers | |
| 4,028,868 A | | 6/1977 | Zehrung, Jr. | |
| 4,060,137 A | | 11/1977 | Bickford et al. | |
| 4,091,890 A | | 5/1978 | Wilmeth et al. | |
| 4,095,917 A | | 6/1978 | Wesner | |
| 4,141,262 A | | 2/1979 | Smith | |
| 4,155,278 A | | 5/1979 | Estok | |
| 4,180,144 A | | 12/1979 | Adams | |
| 4,201,099 A | | 5/1980 | Junkers | |
| 4,201,503 A | | 5/1980 | Nannen | |
| 4,211,150 A | | 7/1980 | Framberg | |
| 4,260,183 A | | 4/1981 | Krupp | |
| 4,275,620 A | | 6/1981 | Collins | |
| 4,308,767 A | | 1/1982 | Wilmeth | |
| 4,336,727 A | | 6/1982 | Junkers | |
| 4,385,533 A | | 5/1983 | Collins | |
| 4,408,363 A | | 10/1983 | Doree | |
| 4,414,701 A | | 11/1983 | Johnson | |
| 4,429,597 A | * | 2/1984 | Grabovac et al. | 81/57.39 |
| 4,448,096 A | | 5/1984 | Collins | |
| 4,513,645 A | | 4/1985 | Grabovac et al. | |
| 4,607,546 A | | 8/1986 | Wagner | |
| 5,152,196 A | | 10/1992 | Garrett | |
| 5,544,553 A | * | 8/1996 | Galat | 81/57.3 |

FOREIGN PATENT DOCUMENTS

| | | |
|---|---|---|
| DE | 2749857 | 11/1977 |
| FR | 671630 | 12/1929 |
| GB | 972449 | 10/1963 |
| SU | 579132 | 12/1975 |

* cited by examiner

*Primary Examiner*—Joseph J. Hail, III
*Assistant Examiner*—David B. Thomas
(74) *Attorney, Agent, or Firm*—Roy, Kiesel, Keegan & DeNicola

(57) ABSTRACT

A runner apparatus is disclosed herein that is used alone or in combination with or incorporated into an existing torque wrench. The runner apparatus has a motor positioned offset from end operatively engaging a threaded member so that the runner apparatus or runner apparatus-torque wrench combination has a profile height that allows it to be positioned in confined spaces that are relatively small.

25 Claims, 10 Drawing Sheets

OFFSET HYDRAULIC RUNNER APPARATUS

CONTINUATION-IN-PART

This is a continuation-in-part of U.S. patent application Ser. No. 09/302,836 filed Apr. 30, 1999 now abandoned which is hereby incorporated by reference in its entirety.

BACKGROUND OF THE INVENTION

1. Field of the Invention

This invention relates generally to a runner apparatus for threaded members, such as nuts and bolts, and more particularly to an apparatus which can operate in an offset manner allowing nuts and bolts to be turned with increased speed and torque in areas where there is decreased clearance within which to fit a runner apparatus and a torque wrench.

2. Prior Art

In applications where numerous sections of tubular members having flanged ends, such as pipes, are connected ("made-up") or disconnected ("break out"), the vertical dimension of confined space within which a torque wrench and a runner apparatus must work to tighten and loosen the nuts and bolts connecting the pipes is often less than six inches. Unfortunately, the total height needed to fit both a torque wrench and a runner apparatus, which includes a motor, is often greater than six inches. When loosening a threaded member in this small confined space, prior art methods employ a torque wrench to provide high torque to the threaded member until the threaded member is sufficiently loose so that a runner apparatus can be employed in place of the torque wrench to completely loosen the threaded member or so that the threaded member could be loosened by hand or a right-angle impact tool. To tighten a threaded member, the opposite sequence of steps is employed. The runner apparatus tightens the threaded member until the threaded member requires greater torque. The runner apparatus is then removed, and the torque wrench is employed to completely tighten the threaded member.

The prior art methods are time consuming and decrease the overall efficiency of operations. The prior art devices and methods are expensive to maintain and create operator fatigue. Thus, a need exists for a positively-activated runner apparatus-torque wrench combination that can decrease the profile height, or height available to fit in the vertical dimension of confined space, without the necessity of removing the torque wrench or runner apparatus during the tightening or loosening process.

ADVANTAGES AND OBJECTS OF THE INVENTION

The present invention provides several advantages. First, because the motor is horizontally offset from the drive gear, adapter, or other socket member operatively engaging a threaded member, the profile height of the runner apparatus-torque wrench assembly has been reduced to fit within the allowed the vertical dimension of confined space. The use of the horizontally offset positioned motor allows the torque wrench and runner apparatus to be used together without removing either the runner apparatus or torque wrench from engagement with the threaded member. The gear and/or pulley configuration of the present invention also allows operators to vary the speed and torque delivered by the runner apparatus, providing a runner apparatus with greater capabilities.

With the aforementioned considerations in mind, it is therefore an object of this invention to provide a runner apparatus-torque wrench assembly that has a low profile height to allow the driving end of the wrench assembly to fit into small confined spaces.

It is a further object of this invention to provide a runner apparatus assembly that can work in an offset manner while providing increased speed or torque.

It is a further object of this invention to provide a runner apparatus that may be used effectively and efficiently by itself or in conjunction with existing torque wrenches to increase the speed or torque applied to the nut or bolt.

It is a further object of this invention to minimize operator fatigue and the maintenance costs associated with the make-up or break-out of sections of tubular members.

These and other advantages and objects of this invention shall become apparent from the ensuing description of the invention.

SUMMARY OF THE INVENTION

The invention herein comprises, in a first embodiment, a wrench for tightening or loosening a threaded member in a confined space and comprises (a) a motor; (b) a runner driver operatively engageable with a threaded member and operatively connected to the motor so that the motor rotates the runner driver; and (c) a housing extending substantially horizontally between the motor and the runner driver, wherein the confined space has a vertical dimension that is less than the sum of the vertical dimension of the motor, the runner driver, and the housing, but greater than the sum of the profile height of the housing and the runner driver.

Another embodiment of the invention comprises (a) a first wrench comprising at least a drive head operatively engageable, with a threaded member; and (b) a second wrench comprising: (i) a motor; (ii) a runner driver operatively engageable with a threaded member and operatively connected to the motor so that the motor rotates the runner driver; and (iii) a housing extending substantially horizontally between the motor and runner driver, wherein a confined space within which the threaded member is positioned has a vertical dimension that is less than the sum of the vertical dimension of the motor, the runner driver, and the housing, but greater than the sum of the profile height of the first and second wrench.

A method of loosening or tightening a threaded member in a confined space using the wrench assembly disclosed herein is also described.

Another embodiment of the present invention is a wrench assembly for loosening or tightening a threaded member in a confined space comprising: (a) a torque wrench comprising at least a drive head operatively engageable with a threaded member and having a vertical dimension; and, (b) a motor in rotational communication with the drive head and positionable horizontally offset from the drive head, wherein the confined space has a vertical dimension that is less than the sum of the vertical dimension of said motor and said torque wrench, but greater than the vertical dimension of said torque wrench.

DETAILED DESCRIPTION OF THE EMBODIMENTS OF THE INVENTION

Figure 1A:
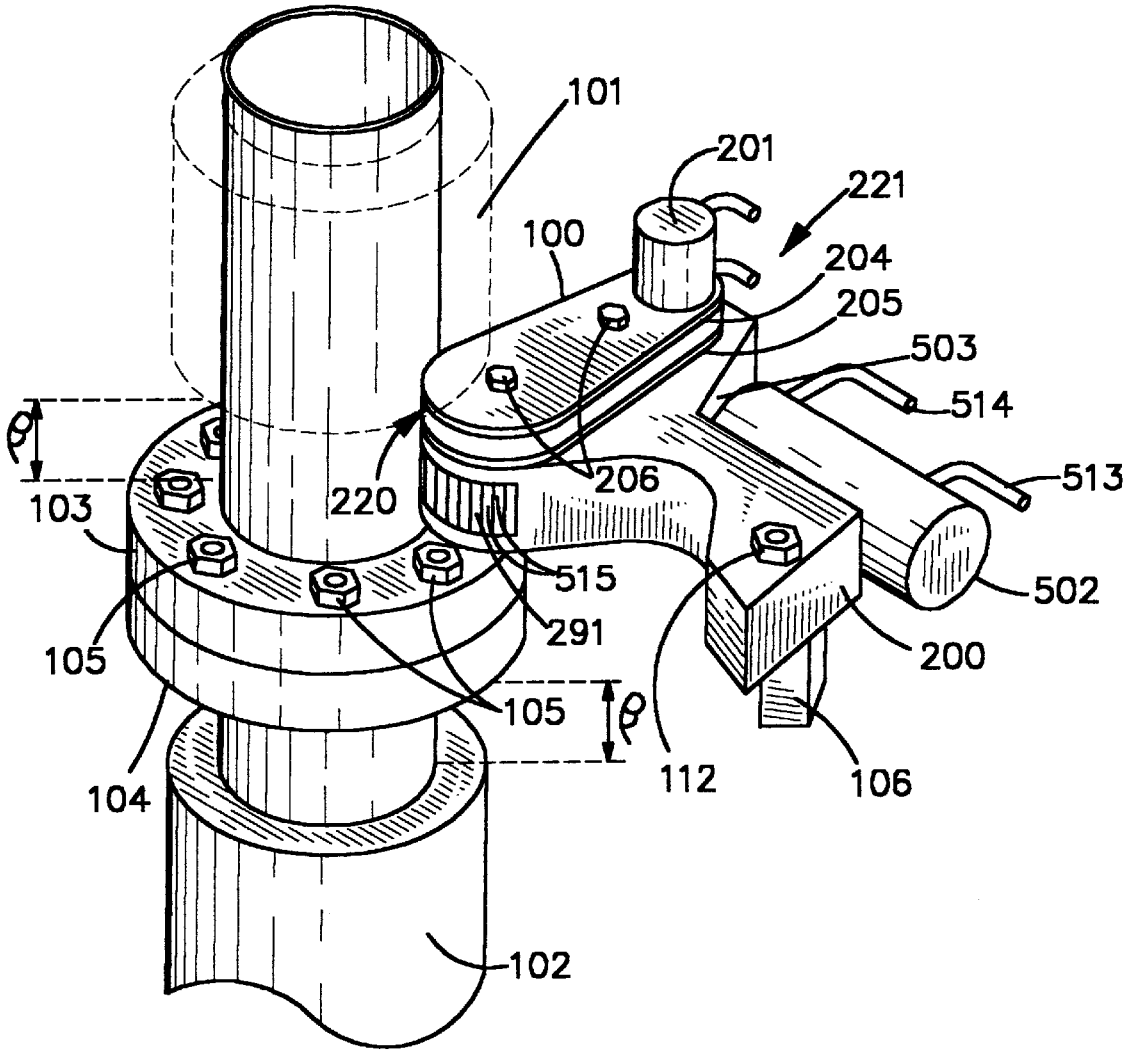
FIG. 1*a* is a perspective view of the invention combining a runner apparatus and a torque wrench shown with the invention engaged with a threaded member on a pipe flange.

As shown in FIGS. 1*a,* 1*b,* and 2, runner apparatus 100 may be used alone (FIG. 1*b*) or in conjunction with a suitable torque wrench 200 (FIG. 1*a,* 2) to tighten or loosen threaded members 105, such as nuts and bolts, positioned in confined spaces. Threaded members 105 connect the flanges 103, 104 of tubular member 101, 102. The vertical dimension of the confined space is typically that dimension shown as confined space β shown in FIGS. 1 and 2, and is usually about six inches in many applications.

Thus, it is desirable that the motor 201 on hydraulic runner apparatus 100 be positioned horizontally offset from the driving end 220 and/or positioned horizontally offset from drive head 291. Motor 201 may be positioned at first end 221. This allows torque wrench 200 and runner apparatus 100 (together referred to a "wrench assembly") to operatively engage and rotate a threaded member 105 within the vertical dimension of confined space β.

As used in the claims, "operatively engage" or "operatively engageable" shall include direct engagement or engagement through an intermediate object, such as an adapter 600 or 600A, discussed below. As used herein, "vertical" shall mean substantially along the y-axis shown in the Figures, while "horizontal" shall mean substantially along the x-axis shown in the Figures.

Figure 1B:
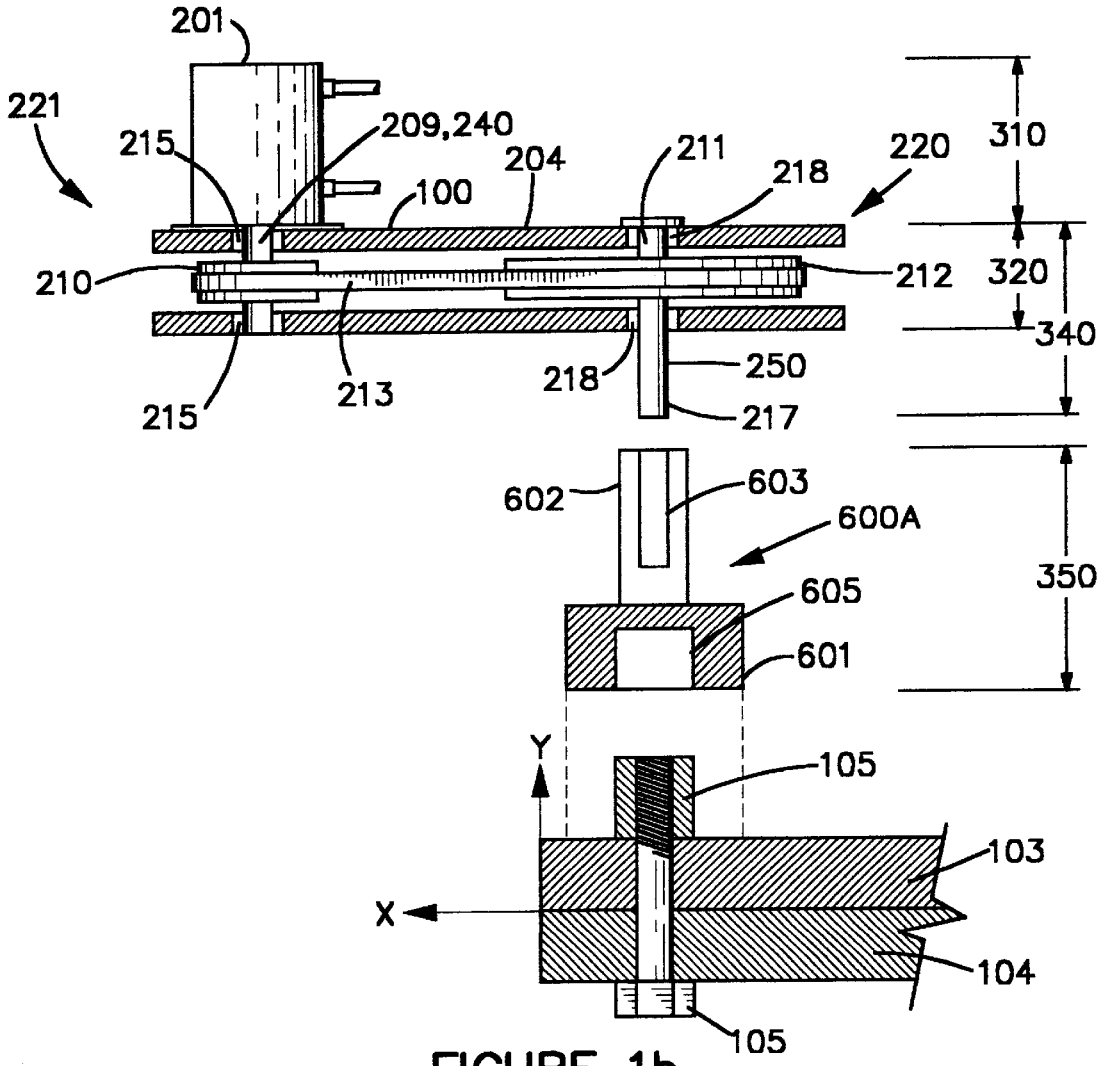
FIG. 1*b* is a cut away exploded view of a runner apparatus shown engaging a threaded member using a suitable adapter.

As shown in FIG. 1*b,* runner apparatus 100 comprises at least a runner driver 250 and a motor 201. Runner driver 250 is operatively engageable with threaded member 105 using a detachable socket member 219 (not shown), which includes a socket for engaging a threaded member, or an adapter 600A, and a motor 201 positioned horizontally offset from runner driver 250. Motor 201 operatively rotates runner driver 250 and is positioned horizontally offset from runner driver at least a sufficient distance when runner driver 250 operatively engages a threaded member 105 so that driving end 220 of runner apparatus 100 is positionable within the vertical dimension of confined space β. Runner apparatus 100 is constructed as described below.

Figure 2:
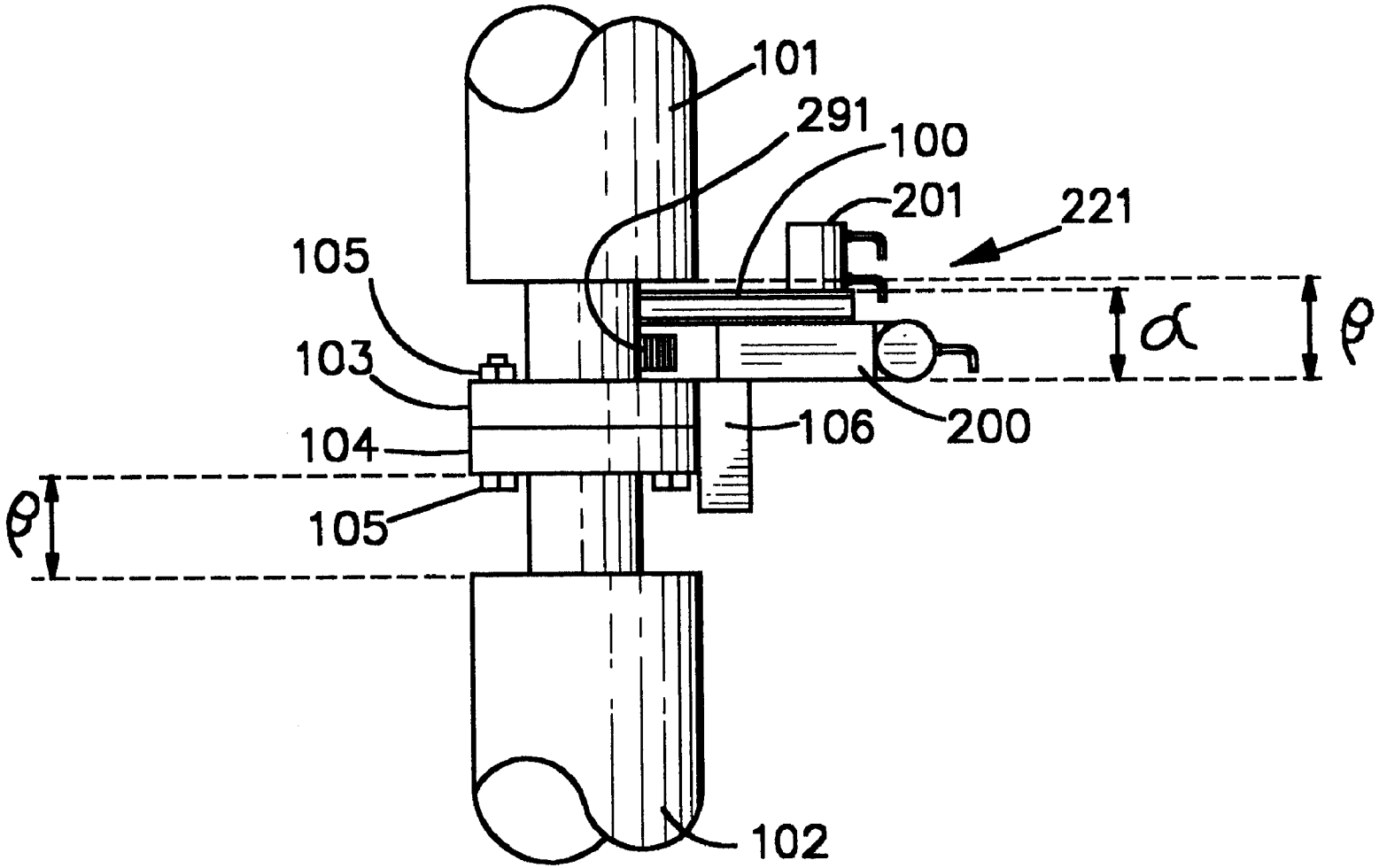
FIG. 2 is a side view of FIG. 1.

Referring to FIGS. 1*a* and 2, torque wrench 200 is preferably used for high-torque applications, such as initially loosening a tightened threaded member 105 or the final tightening of a threaded member 105 when runner apparatus 100 can no longer provide sufficient torque to rotate threaded member 105. Torque wrench 200 may comprise any suitable torque wrench such as a torque wrench disclosed in U.S. Pat. No. 4,448,096, which is incorporated by reference herein, or a suitable torque wrench available from Power Tork Hydraulics, Inc. of Kenner, La.

Figure 3A:
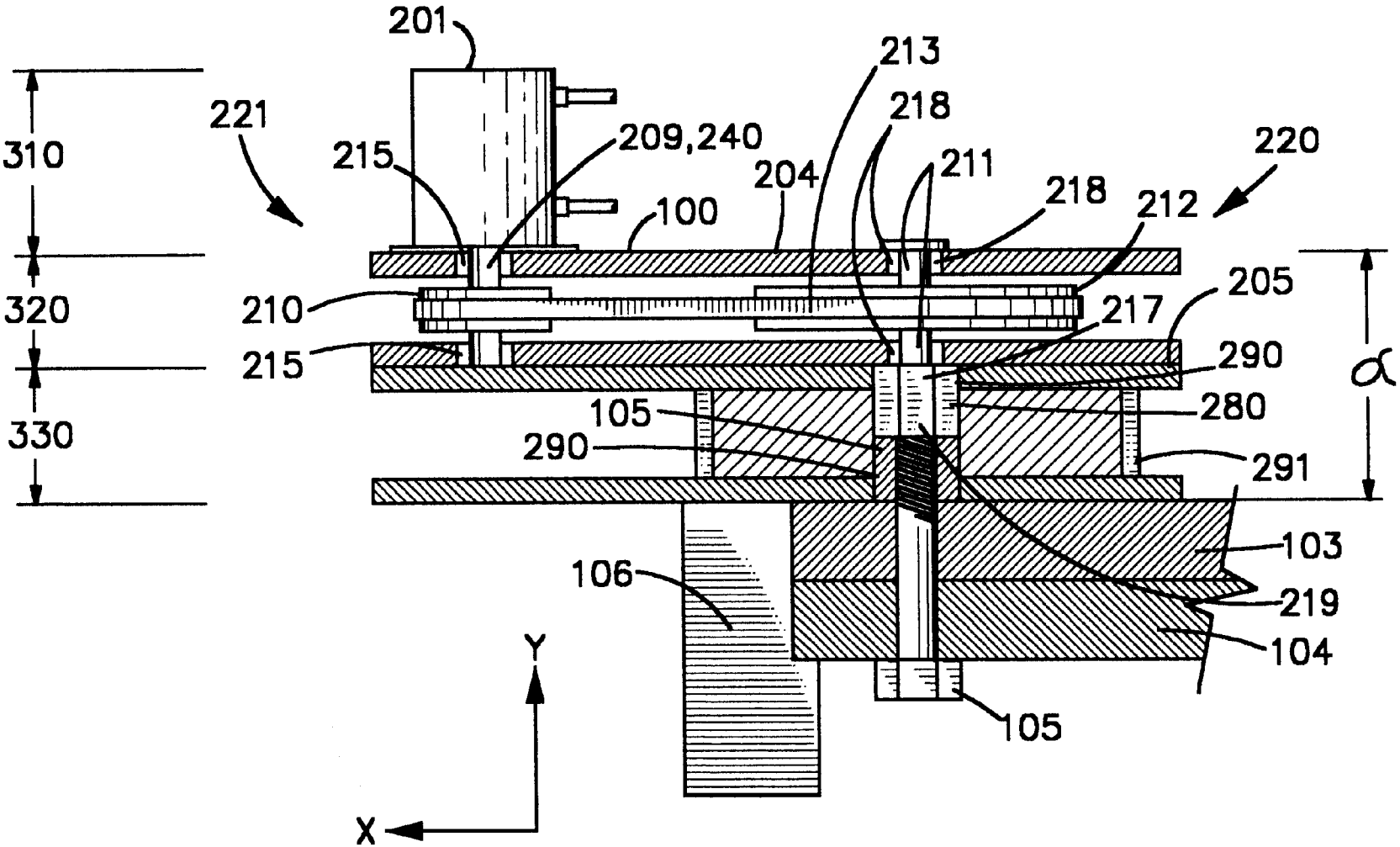
FIG. 3*a* is a cut away view of the invention shown engaged with a threaded member. The runner apparatus is shown with the sidewall cut away, while the torque wrench and pipe flanges are shown as cross-sections. The torque wrench is shown with the driving mechanism shown in FIG. 1*a* and 5 loosened.
Figure 3B:
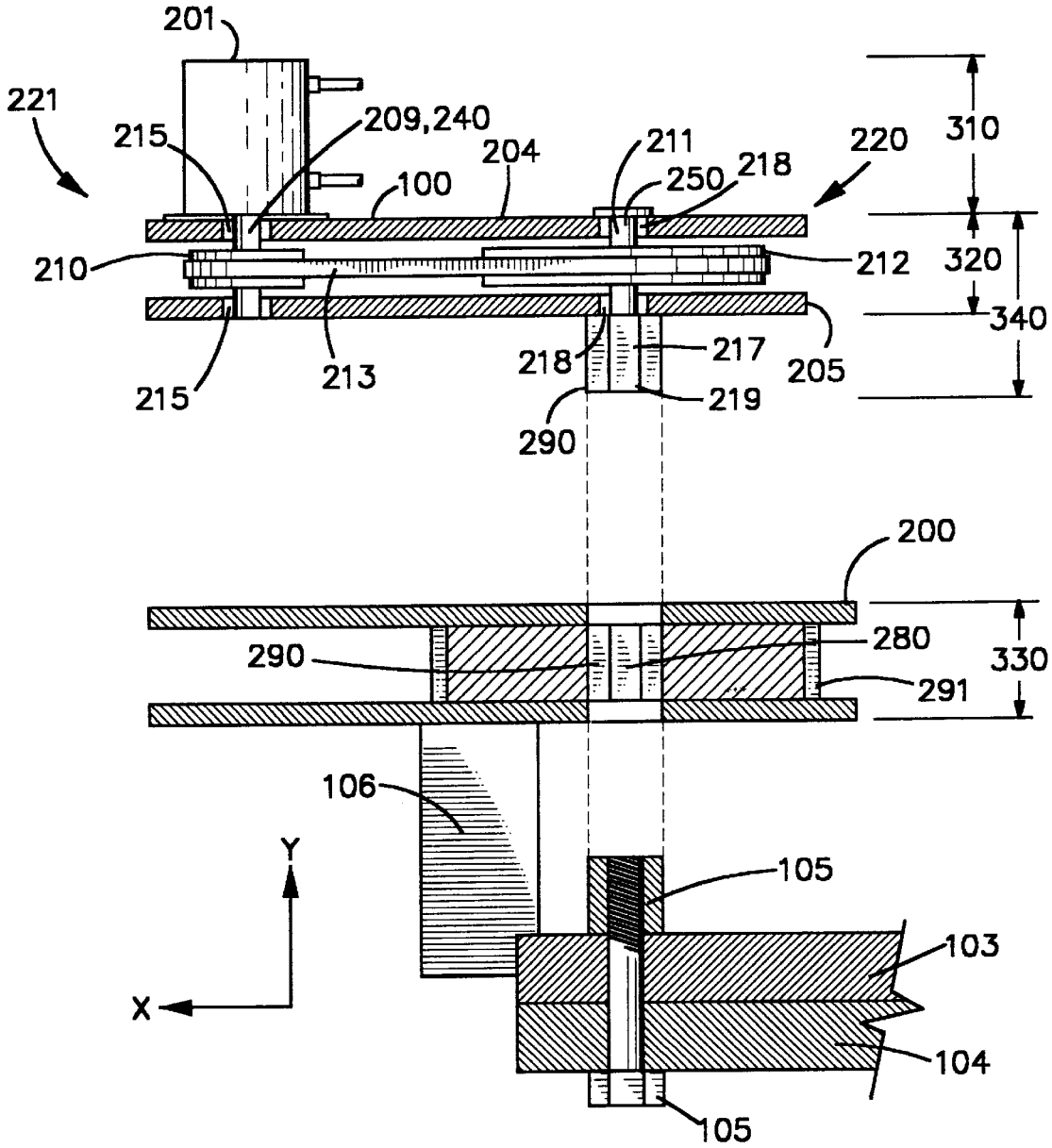
FIG. 3*b* is an exploded view of FIG. 3*a*.

As shown in FIG. 3*b,* torque wrench 200 includes a drive head 291, having socket 280 configured therein, positioned in torque wrench 200. Drive head 291 is constructed so that threaded member 105 may operatively engage one end of socket 280 and driver end 217 of runner driver 250 may operatively engage the opposite end of socket 280.

Torque wrench 200 also includes a reaction bar 106 attached at aperture 501 (see FIG. 5) using suitable nut 112 (or bolt depending on the configuration of reaction bar 106) to prevent the torque applied to threaded member 105 from causing torque wrench 200 to rotate about threaded member 105 when torque is applied to threaded member 105. Reaction bar 106 abuts flanges 103, 104 so that flanges 103, 104 prevent torque wrench 200 from kicking, or rotating about threaded member 105.

Figure 5:
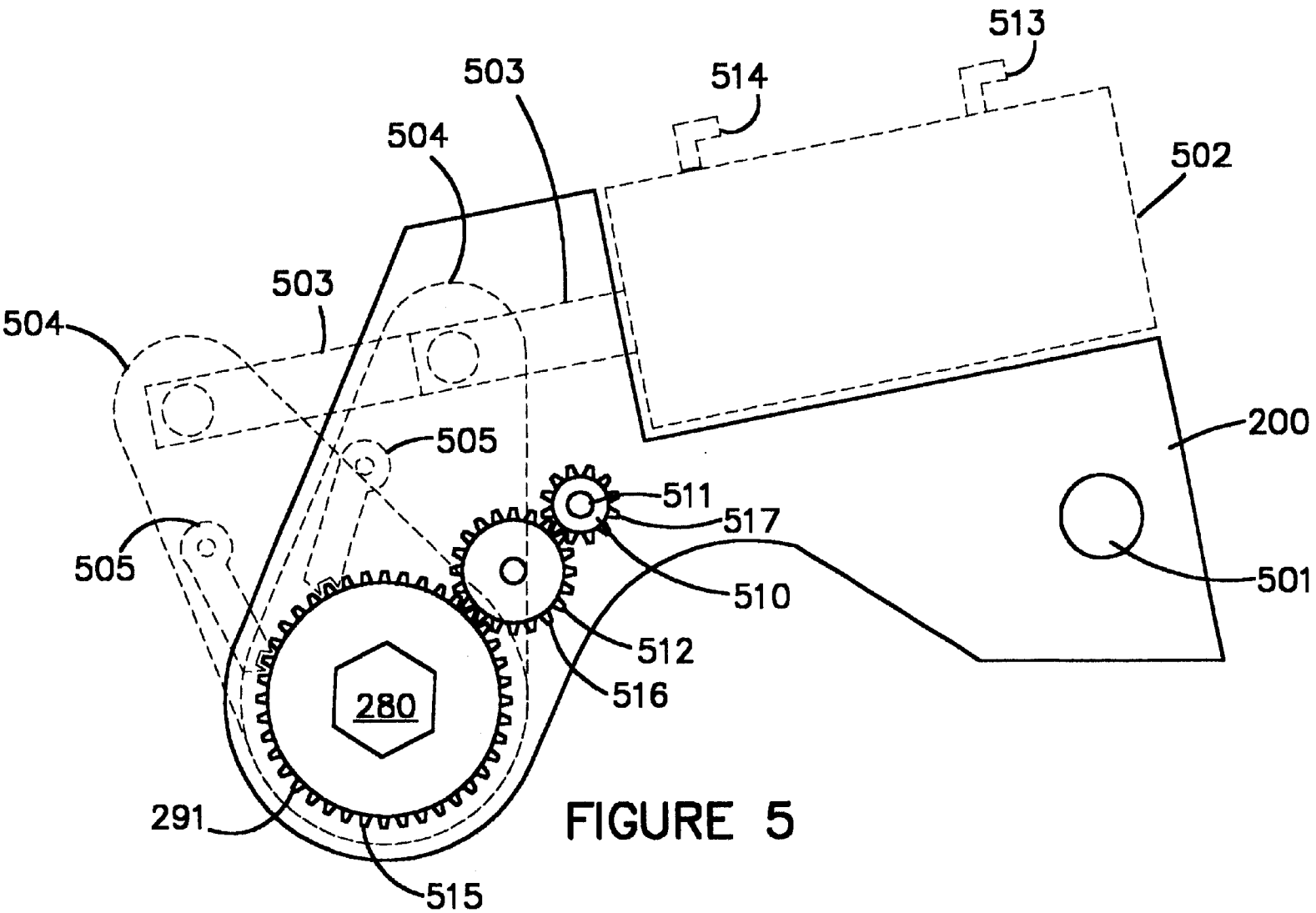
FIG. 5 is an upper view of a cross-section of a torque wrench incorporating an internal gear offset runner assembly.

Referring to FIGS. 1*a* and 5, torque wrench 200 operates by flowing hydraulic fluid from a source of hydraulic fluid to a hydraulic cylinder 502 through extension port 513 and/or retraction port 514 to cause extension and/or retraction of piston arm 503. Referring to FIG. 5, the extension and retraction of arm 503 cause movement of tool drive plates 504, forcing drive pawl 505 to engage teeth 515 on drive head 291 and rotate drive head 291. As arm 501 retracts, drive pawl ratchets back along teeth 513, and the process is repeated until threaded member 105 is torqued a desired amount. The torque wrench 200 preferably used in connection with the present invention can provide at least 10,000 ft-lbs. of torque, and preferably upwards of 34,000 ft-lbs. of torque or higher.

As best seen in FIGS. 2, 3*a* and 3*b,* motor 201 is positioned horizontally offset from driving end 220 and/or positioned horizontally offset from drive head 291 at least a sufficient distance so that when runner driver 250 (or socket member 219) engages torque wrench socket 280 in torque wrench drive head 291, the wrench assembly has a profile height α that allows the wrench assembly to operatively engage threaded member 105 positioned within the vertical dimension of confined space β. Typically, while dimensions may vary, the profile height α is below about 6 inches, more preferably about 5.75 inches, while the vertical dimension of confined space β is generally about or above about 6 inches.

Runner apparatus 100 is preferably employed to tighten or loosen threaded members 105 using high rotational speed. Runner apparatus 100 may also be used in combination with torque wrench 200 where additional torque is needed to completely tighten or loosen threaded member 105. In some applications, runner apparatus 100 may be able to apply the necessary torque to completely tighten a threaded member 105.

Referring to FIGS. 3*a* and 3*b,* runner apparatus 100 has a housing 295 that may comprise an upper housing plate 204 and a lower housing plate 205, although a suitably constructed single plate embodiment would also work. Housing 295 provides support to runner driver 250 and motor 201 and is sufficiently sized to allow motor 201 to remain external of confined space β when runner driver 250 is inserted into the vertical dimension of confined space β and operatively engages threaded member 105 by providing sufficient horizontal separation between motor 201 and runner driver 250. Motor 201 can be any suitable motor powered hydraulically by a suitable source of hydraulic fluid or motor 201 may be electrically- or air-driven. Motor 201 rotates motor driver 240. One or more connectors 206, such as bolts, attach runner apparatus 100 to torque wrench 200 as shown in FIG. 1*a*.

Runner apparatus 100 is attached, preferably removably attached, to torque wrench 200 so that runner apparatus 100 may be positioned on either side of torque wrench 200 so that runner apparatus 100 can be employed on both make-up and break-out operations. Torque wrench 200 operates on both make-up and break out operations by simply flipping torque wrench 200, thereby reversing the operative rotational direction.

Referring back to FIGS. 3*a* and 3*b*, motor 201 is operatively engaged with a motor driver 240 which may comprise a shaft 209 or may comprise shaft 209 having a pulley 210 or a gear 300 (shown in FIG. 4*a*) attached thereto. Shaft 209 operatively engages plates 204, 205 at rear bushings 215 (bearings would also work) and terminates flush or below flush with the upper surface of upper plate 204 and the lower surface of lower plate 205.

Runner driver 250 is positioned horizontally offset from motor 201 so that the total profile eight α of runner apparatus 100 and torque wrench 200 is less than the vertical dimension of confined space β. Runner driver 250 has a shaft end 211 and a driver end 217. Shaft end 211 operatively engages plates 204, 205 at front bushings 218 and terminates flush or below flush with the upper surface of upper plate 204. Runner driver 250 may also comprise a pulley 212 or a gear 302 (shown in FIG. 4*a*) attached thereto.

Driver end 217 of runner driver 250 extends through lower plate 205 and may also comprise a socket member 219 that is insertable into torque wrench socket 280 of drive head 291. Socket member 219 may be constructed as part of runner driver 250 or may be detachable so that different-sized socket members 219 may attach to runner driver 250 to engage different-sized torque wrench sockets 280. Alternatively, socket adapters (not shown) may be positioned between socket member 219 and socket 280, as long as profile height α is less than the vertical dimension of confined space β. The outer surface 290 of socket member 219 may be square, hexagonal, or any other shape corresponding to the inner configuration of torque wrench socket 280.

Although the embodiments shown in FIGS. 3*a* and 3*b* are shown with socket 280 extending completely through drive head 291, drive head 291 could be constructed with separate sockets, one to operatively engage runner driver 250 (or socket member 219) and one to operatively engage a threaded member 105 either directly or through an adapter 600.

Figure 4C:
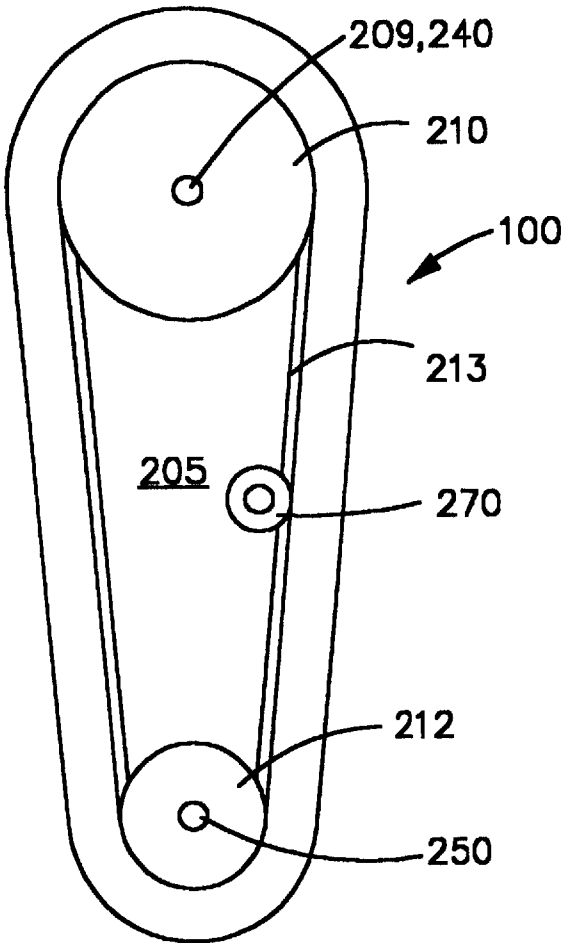
FIG. 4*c* is an upper view of a cross-section through an alternate embodiment of the runner apparatus where pulleys and a belt are employed and where the positions of the larger and smaller pulleys are reversed from that shown in FIG. 4*b*.
Figure 4B:
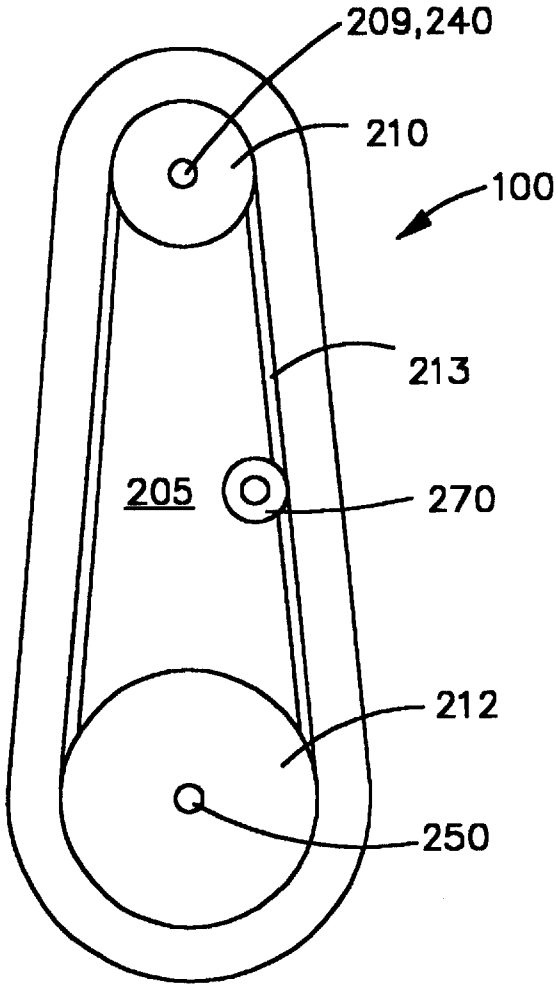
FIG. 4*b* is an upper view of a cross section through the runner apparatus where pulleys and a belt are employed.
Figure 4A:
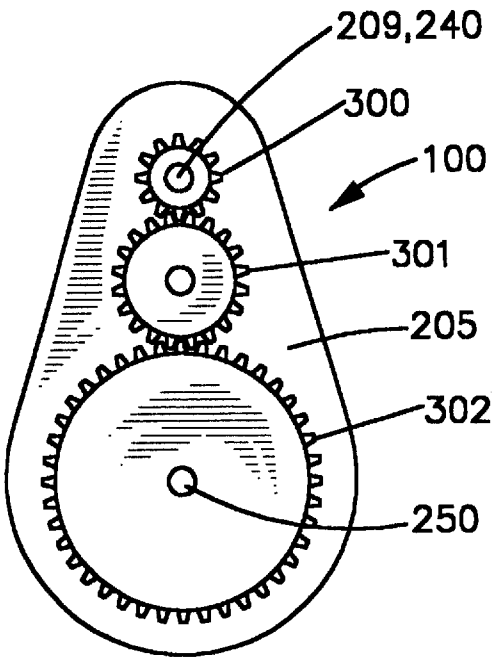
FIG. 4*a* is an upper view of a cross section through the runner apparatus where gears are employed.

Referring to FIGS. 4*a*-4*c*, in an embodiment of the invention where corresponding pulleys 210, 212 are positioned on motor driver 240 and runner driver 250, a belt 213 may extend around and between pulleys 210, 212 so that rotation of motor driver 240 provides rotational drive to runner driver 250. A tension pulley 270 keeps tension in belt 213. Alternatively, as shown in FIG. 4*a*, gears 300, 302 having communicating teeth are used, and if necessary, at least one intermediate spacer gear 301 is operatively positioned between gears 300, 302. A chain (not shown) may extend around and between gears 300, 302, similar to the belt shown in FIGS. 4*b* and 4*c* so that gears 300, 301, 302 are in rotational communication.

The speed and torque applied to threaded member 105 can be varied by using pulleys 210, 212 or gears 300, 302 having different sized diameters on the respective drivers 240, 250. If increased torque is needed, a smaller diameter pulley or gear is positioned on motor driver 240, while a larger diameter pulley or gear is positioned on runner driver 250. If increased speed is desired, a larger diameter pulley or gear is positioned on shaft 240, while a smaller diameter pulley or gear is positioned on shaft 250.

For example, in an embodiment where only runner apparatus 100 is used to loosen or tighten a threaded member 105, a 3-1 motor driver-runner driver diameter ratio is used in connection with a motor 201 capable of providing about 500 ft-lbs. of torque and about 585 revolutions per minute (rpm) to provide upwards of about 1500 ft-lbs. of torque applied to threaded member 105 at about 190 rpm.

In embodiments where runner apparatus 100 is used to tighten or loosen a threaded member in conjunction with a torque wrench 200, a 1-1 motor driver-runner driver diameter ratio is used with a motor 201 capable of providing about 500 ft-lbs. of torque and about 585 rpm so that the full rotational speed of motor 201 (up to about 585 rpm) can be used to rotate threaded member 105.

Figure 6:
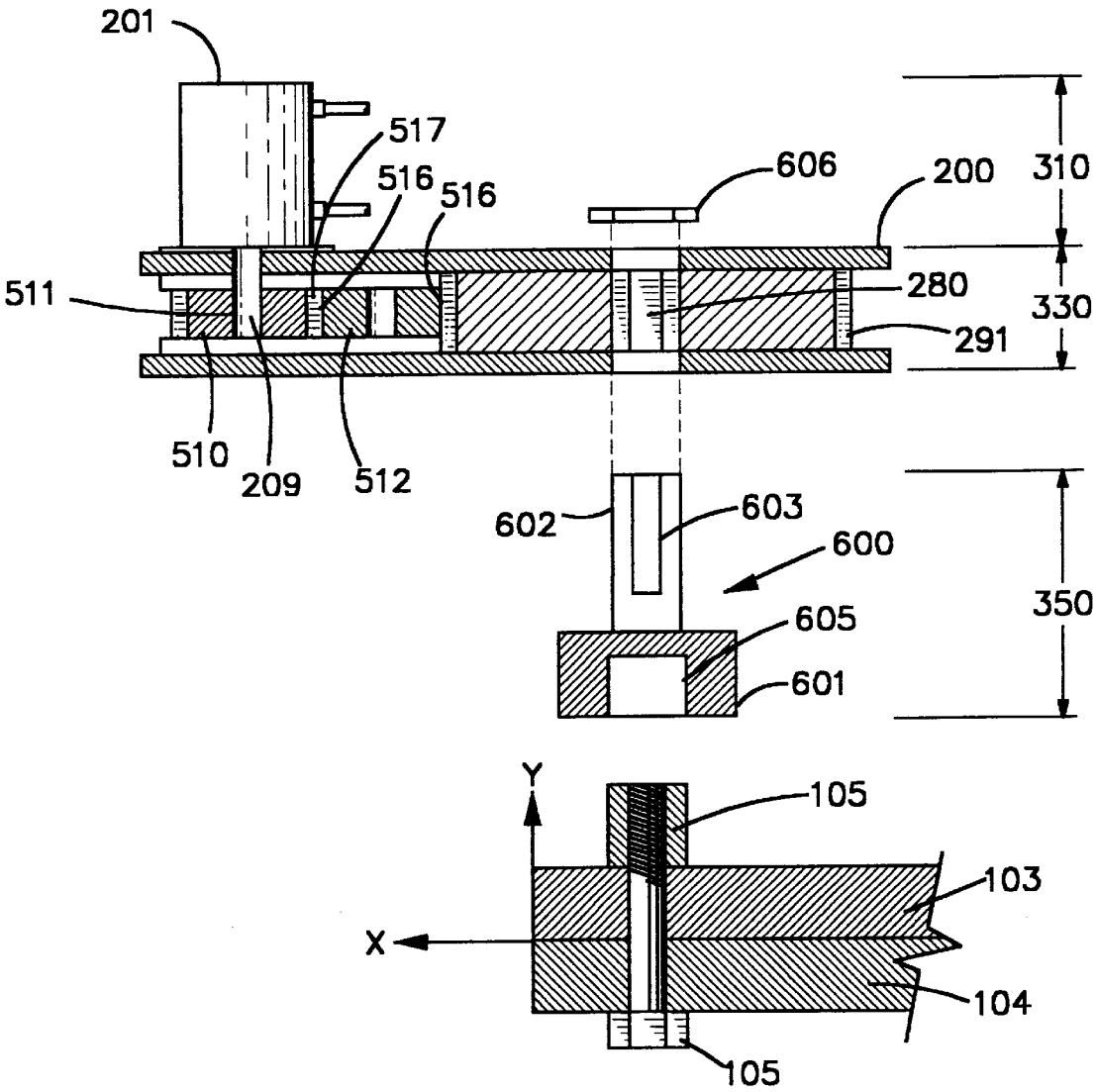
FIG. 6 is an exploded side cross-section view of the invention shown in FIG. 5 also incorporating an adapter. For clarity, the reaction bar is not shown.

Another embodiment of the invention is shown in FIGS. 5 and 6 where the offset runner invention is incorporated as part of torque wrench 200. Motor gear 510 is positioned horizontally offset from drive head 291 at least a sufficient distance to allow torque wrench 200 to operatively engage and rotate a threaded member 105 within the vertical dimension of confined space β when motor shaft 209 engages gear aperture 511 (from either the top or the bottom of torque wrench 200). Thus, the body of torque wrench 200 provides a housing to support drive gear 291 and motor 201 and is sufficiently sized to allow motor 201 to remain external of confined space β when drive gear 291 (and adapters 600 or 600A) is inserted into the vertical dimension of confined space β and operatively engages threaded member 105 by providing sufficient horizontal separation between motor 201 and runner driver 250.

Motor gear 510 may directly engage drive head 291, or alternatively, an intermediate gear 512 is operatively positioned between motor gear 510 and drive head 291, so that the teeth 515 on drive head 291 operatively engage the teeth 516 on intermediate gear 512, which operatively engage the teeth 517 on motor gear 510. The rotation of motor shaft 209 by motor 201 causes rotation of drive head 291 through the action of gears 510, 512.

FIG. 6 illustrates the embodiment shown in FIG. 5 used in conjunction with an adapter 600 to allow drive head 291 to operatively engage threaded member 105. Adapter 600 has a first end 601 operatively engageable with a threaded member 105 via socket 605. Adapter 600 has a second end 602 that is insertable through drive head socket 280 and engageable with a retaining member 606. Retaining member 606 may comprise a nut that engages a threaded second end 602, or may comprise a retaining pin inserted through an aperture in second end 602. Retaining member 606 prevents adapter 600 from disengaging drive head 291 during operation.

Figure 7:
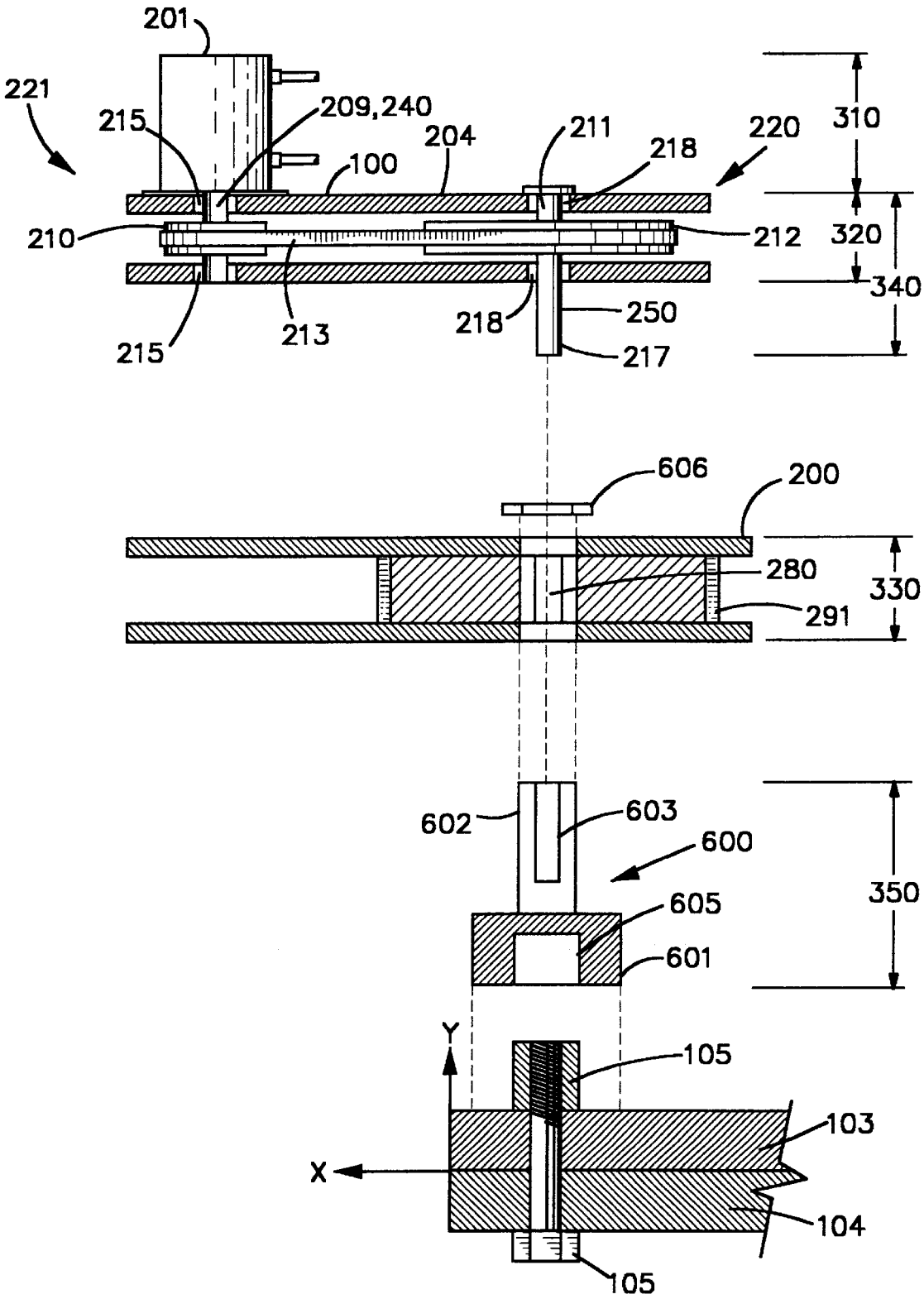
FIG. 7 is an exploded cross-section of an embodiment of the invention employing an adapter. For clarity, the reaction bar is not shown.

FIG. 7 illustrates another embodiment of the invention where an adapter 600A, similar to the adapter 600A previously discussed, is used in connection with an embodiment similar to the embodiment shown in FIGS. 3*a* and 3*b*. Retaining member 606 positions adapter 600A within drive head socket 280 in torque wrench 200. Adapter 600A has a drive bore 603 configured within second end 602. Runner driver 250 has extended drive end 217 that slidably inserts within drive bore 603 so that rotation of runner driver 250 causes rotation of adapter 600A (and thus drive head 291) and threaded member 105. Thus, the use of adapter 600A allows runner driver 250 to operatively engage drive head 291 (at socket 280) and allows drive head 291 to operatively engage threaded member 105.

The outer surface of second end 602 is configured to be the same shape as the configuration of drive head socket 280 (i.e. square, hexagonal, etc.), while the outer surface of drive end 217 on runner driver is configured to be the same shape as drive bore 603 so that drive end 217 slidably inserts within drive bore 603.

Adapters 600, 600A are preferably constructed so that the adapter vertical dimension 350 is kept to a minimum distance allowing the invention to be used in small confined spaces. The drive bore 603 in adapter 600A and the driver end 217 of runner apparatus are also constructed so that the overall profile height of an embodiment incorporating both features is kept to a minimum.

The embodiments shown in FIGS. 3*a* and 3*b* operate as follows. With threaded member 105 connecting flanges 103, 104, driver end 217 of runner driver 250 is inserted into a first end of torque wrench socket 280 in drive head 291. The wrench assembly, comprising torque wrench 200 and runner apparatus 100, is positioned over threaded member 105 so that threaded member 105 is positioned within torque wrench socket 280 in drive head 291. Alternatively, as shown in FIG. 7, an adapter 600 is positioned within socket 280, drive end 217 inserts within drive bore 603, and socket 605 operatively engages threaded member 105.

If threaded member 105 is being tightened, motor 201 is operated so that motor driver 240 operatively rotates runner driver 250, thereby rotating drive head 291 (and adapter 600 or 600A), and threaded member 105 until the torque required to continue tightening threaded member 105 is so great that torque wrench 200 must be operated. Torque wrench 200 is operated until the threaded member 105 has been tightened to a desired torque.

When threaded member 105 is to be loosened, torque wrench 200 is operated to apply the torque necessary to initially loosen threaded member 105 so that runner apparatus 100 may be employed. Motor 201 is then operated so that motor driver 240 operatively rotates runner driver 250, thereby rotating drive head 291 (and adapter 600 or 600A) and threaded member 105 until threaded member 105 has been completely loosened.

The embodiments shown in FIGS. 5 and 6 operate as follows. With threaded member 105 connecting flanges 103, 104, socket 280 may operatively engage threaded member 105, or adapter 600 or 600A may be used to operatively engage threaded member 105, as previously described. The shaft 209 of motor 201 is inserted through the top or bottom of torque wrench 200 into motor gear aperture 511. Motor 201 is then operated, rotating gears 510, 512, and rotating drive head 291 until threaded member 105 is (a) completely loosened (during break-out); or, (b) tightened (during make-up) to the point that torque wrench 200 is required to provide the additional torque needed to completely tighten threaded member 105.

In the embodiments described herein, motor 201 is preferably a hydraulic motor capable of providing about 500 ft-lbs. of torque and rotational speed of about 585 rpm. Referring to the embodiment in FIGS. 3*a* and 3*b*, with motor 201 attached to the invention the vertical dimension of torque wrench 200, housing 295, and motor 201 is about 11⅞ inches. Motor 201 is also preferably offset at least about 5½ inches from drive head 291 to allow the wrench assembly to be insertable into confined space β so that the profile height α of the wrench assembly within the vertical dimension of confined space β is only about 5¾ inches.

In each of the embodiments shown, motor 201 has a vertical dimension 310, housing 295 has a vertical dimension 320, torque wrench 200 has a vertical dimension 330, and runner driver 250 has a vertical dimension 340. For the purposes of calculating the sums of vertical dimensions and profile heights, any vertical dimensions of one component that overlap with another component, which is positionable with the vertical dimension of confined space β, are not counted. For example, in referring to FIG. 1*a*, profile height α of runner apparatus 100 is the housing vertical dimension 320 plus the vertical dimension 350 of adapter 600A. The runner driver vertical dimension 340 is not counted because substantially all portions of the runner driver vertical dimension 340 overlap either housing vertical dimension 320 or adapter vertical dimension 350.

For example in the embodiment shown in FIG. 1*a*, the profile height α of runner apparatus 100 is the sum of the housing vertical dimension 320 and the adapter vertical dimension 350, minus any overlapping portions. Runner driver vertical dimension 340 is not counted because substantially all portions of the runner driver vertical dimension 340 overlap the housing vertical dimension 320 or the adapter vertical dimension 350. Thus in FIG. 1*a*, driver end 220 of runner apparatus 100 will insert within a confined space β having a vertical dimension greater than profile height α of runner apparatus 100.

In the embodiments shown in FIGS. 3*a*, 3*b*, the profile height α of the runner apparatus 100 torque wrench 200 combination is the sum of the housing vertical dimension 320 and the torque wrench vertical dimension 330, minus any overlapping portions. Thus in FIGS. 3*a* and 3*b*, driver end 220 of the runner apparatus 100-torque wrench 200 combination will insert within a confined space β having a vertical dimension greater than profile height α of runner apparatus 100-torque wrench 200 combination.

In the embodiments shown in FIGS. 5 and 6, the profile height α of torque wrench 200 equals the sum any vertical dimension of retaining member 606 and torque wrench vertical dimension 330. As shown in FIG. 6, the profile height α equals the sum any vertical dimension of retaining member 606, torque wrench vertical dimension 330, adapter vertical dimension 350, minus any overlapping portions. Thus in FIGS. 5 and 6, driver end 220 of torque wrench 200 will insert within a confined space β having a vertical dimension greater than profile height α of torque wrench 200.

In the embodiment shown in FIG. 7, the profile height α equals the sum of housing vertical dimension 320, any vertical dimension of retaining member 606, torque wrench vertical dimension 330, and adapter vertical dimension 350, minus any overlapping portions. Thus in FIG. 7, driver end 220 of the runner apparatus 100-torque wrench combination will insert within a confined space β having a vertical dimension greater than profile height α of the runner apparatus 100-torque wrench 200 combination shown in FIG. 7.

In each of the embodiments, motor 201 is positioned a sufficient horizontal distance from runner driver 250 or drive head 291 to allow operative engagement of a threaded member 105 by runner driver 250, drive head 291, or adapters 600, 600A. This horizontal offset positioning is required because the sum of the motor vertical dimension 310, and combinations of housing vertical dimension 320, torque wrench vertical dimension 330, runner vertical dimension 340, and adapter vertical dimension 350 (minus any overlap thereof) is greater than the vertical dimension of confined space β.

A valve assembly is also preferably incorporated into the hydraulic lines which provide hydraulic fluid to motor 201 and torque wrench 200 to control fluid flow between a source of hydraulic fluid and motor 201 or torque wrench 200. The valve assembly should control flow such that when hydraulic fluid flows into and operates motor 201, fluid does not flow into the hydraulic cylinder of torque wrench 200, and vice versa.

Figure 8:
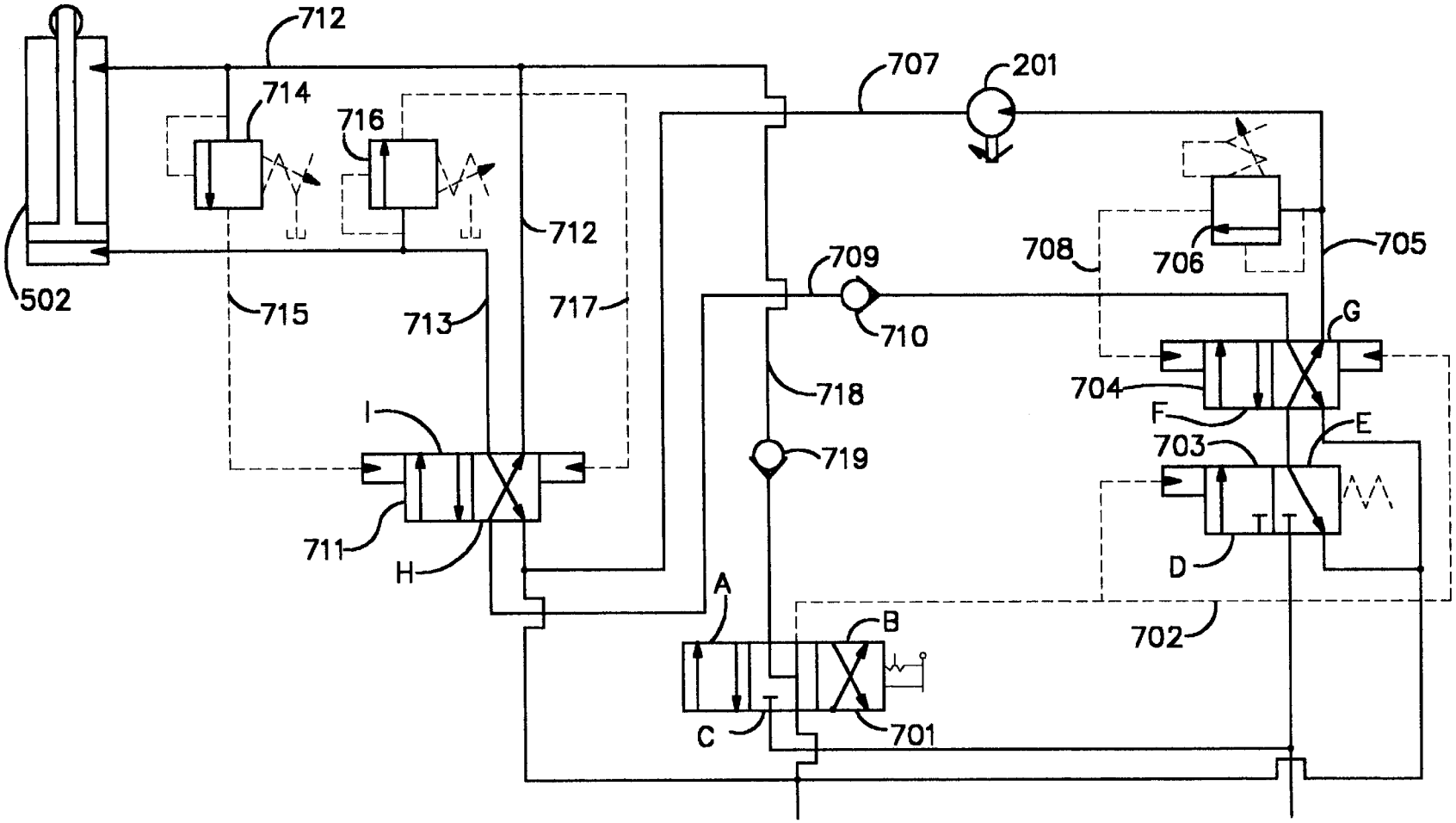
FIG. 8 is a schematic diagram illustrating an embodiment of the invention in which the torque wrench will automatically switch from a low torque high speed rotation of the threaded member to a high torque low speed rotation.

FIG. 8 schematically illustrates one preferred valve assembly. In this configuration, the valve assembly will cause hydraulic power to automatically switch from motor 201 to hydraulic cylinder 502 when the pre-set torque has been reached. In this valve assembly, there is an operator control valve 701 that has a first position A, a second position B, and a third position C. In third position C, the hydraulic system is cut off from hydraulic pressure and the wrench is effectively off. In positions A and B the wrench is pressurized and each will be explained below.

A pilot line 702 connects pilot valves 703 and 704 to the pressure source when operator control valve 701 is in position B. Pilot valves 703 and 704 have positions D and E and positions F and G, respectively. When pilot line 702 is pressurized it will move pilot valve 703 into position D and pilot valve 704 in to position G. Pilot valve 703 is preferably biased to return to position E when pilot line 703 is not pressurized. When pilot valve 703 is in position D and pilot valve 704 is in position G, the pressure source will be connected to motor line 705. When pilot valve 703 is in position E motor line 705 will be cut off from the pressure source.

When motor line 705 is pressurized, motor 201 will be pressurized and will turn until a preset torque is reached. Hydraulic fluid may return to the tank via return line 707 when it has passed through motor 201. Motor line 705 will preferably contain a control valve 706 which will have an open position and a closed position. Control valve 706 will be biased into closed position. In its closed position, control valve 706 will allow hydraulic fluid to reach motor 201. However, as motor 201 tightens threaded member 105, more and more torque will be required to rotate threaded member 105 further. As higher torque levels are achieved, the pressure in motor line 705 will increase. When the pressure in motor line 705 reaches the preset limit, control valve 706 will move from its closed position to its open position and allow hydraulic fluid to flow into pilot line 708. When pilot line 708 is pressurized, it will move pilot valve 704 from position G to position F. When pilot valve 704 is in position F, hydraulic cylinder 502 will be connected to the pressure source, as explained below. Thus, when the torque required to continue rotating threaded member 105 with motor 201 reaches a sufficient level, the pressure in motor line 705 will reach levels sufficient to move control valve 706 into its open position, and the hydraulic fluid will be automatically (without operator interaction) redirected from low torque high speed motor 201 to high torque low speed hydraulic cylinder 502.

When pilot valve 704 is in position F, it will pressurize connecting line 709. Connecting line 709 preferably contains a check valve 710 to prevent hydraulic fluid from flowing back through connecting line 709 to pilot valve 704. Connecting line 709 connects pilot valve 711 to the pressure source. Pilot valve 711 has a first position H and a second position I. When pilot valve 711 is in first position H, retraction line 712 will be connected to the pressure source. When retraction line 712 is pressurized, the retraction side of hydraulic cylinder 502 will be pressurized and the piston in hydraulic cylinder 502 will retract.

Retraction line 712 contains a control valve 714. Control valve 714 has an open position and a closed position and is biased into its closed position. In its closed position, control valve 714 allows hydraulic fluid to flow through retraction line 712 to hydraulic cylinder 502. In its open position, control valve 714 will direct hydraulic fluid into pilot line 715. When pilot line 715 is pressurized, it will move pilot valve 711 into second position I.

Control valve 714 will move into its open position when the piston in hydraulic cylinder 502 is fully retracted. When the piston is fully retracted, the pressure in hydraulic cylinder 502 and retraction line 712 will continue to rise until the pressure exceeds the amount needed to move control valve 714 into its open position. As stated above, when control valve 714 moves into its open position, pilot line 715 will be pressurized and will move pilot valve 711 into its second position I.

When pilot valve 711 is in its second position I, it will connect extension line 713 to the pressure source. When connected to the pressure source, extension line 713 will pressurize the extension side of hydraulic cylinder 502, which will cause the piston in hydraulic cylinder 502 to extend.

Extension line 713 contains a control valve 716. Control valve 716 has an open position and a closed position, and should be biased to its closed position. When control valve 716 is in its closed position, it will allow hydraulic fluid to flow through extension line 713 to hydraulic cylinder 502. However, when control valve 716 is in its open position, it will direct hydraulic fluid into pilot line 717. When pilot line 717 is pressurized, it will cause pilot valve 711 to return to its first position H.

Control valve 716 will be moved into its open position by the pressure in extension line 713 exceeding a preset value. Pressure in extension line 713 will increase for one of two reasons. First, as threaded member 105 is tightened, it will require additional torque to be tightened further. As this additional torque is generated, the pressure in hydraulic cylinder 502 and extension line 713 will increase. Thus, when threaded member 105 has been tightened to its maximum desired torque, control valve 716 will move into its open position as the pressure in extension line 713 rises to levels sufficient to overcome the bias on control valve 716.

The second and more common way that the pressure in extension line 713 will rise to levels sufficient to cause control valve 716 to move into its open position will be when the piston in hydraulic cylinder 502 is fully extended. When the piston is fully extended, the pressure in hydraulic cylinder 502 and extension line 713 will continue to rise until the pressure exceeds the amount needed to move control valve 716 into its open position.

Thus, pilot valve 711 will start out in its first position H which will cause the retraction side of hydraulic cylinder 502 to be pressurized. When the piston in hydraulic cylinder 502 is fully retracted, the pressure in extension line 712 will build until control valve 714 opens which will cause pilot valve 711 to switch to its second position I. In second position I, pilot valve 711 will pressurize the extension side of hydraulic cylinder 502 and extend the piston. When the piston is fully extended, the pressure in extension line 713 will build until control valve 716 opens, which will cause pilot valve 711 to return to its original position H. Thus, pilot valve 711 will automatically switch back and forth between its first position H and its second position I at the end of each complete extension and retraction of the piston. This will allow torque wrench 200 to continue tightening threaded member 105 until the threaded member 105 is tightened to a predetermined torque without operator interaction.

In the event that hydraulic cylinder 502 should, for any reason, not retract fully, in the preferred embodiment, operator control valve 701 may be switched to position A. When operator control valve 701 is in position A, it will pressurize connecting line 718. Connecting line 718 will preferably be provided with a check valve 719 to prevent hydraulic fluid from flowing back into operator control valve 701 through connecting line 718. When connecting line 718 is pressurized, it will pressurize retraction line 712, which in turn will pressurize the retraction side of hydraulic cylinder 502 and cause the piston in hydraulic cylinder 502 to retract.

Although the preferred embodiment has been described, it will be appreciated by those skilled in the art to which the present invention pertains that modifications, changes, and improvements may be made without departing from the spirit of the invention defined by the claims

We claim:

1. A wrench assembly for loosening or tightening a threaded member in a confined space, comprising:

(a) a first non-manual wrench configured to engage and rotate a threaded member; and (b) a second wrench comprising:

(i) a motor;

(ii) a runner driver configured to engage said threaded member, said runner driver operatively connected to said motor, whereby said runner driver and said threaded member may be rotated independently of said first wrench; and (iii) a housing extending substantially horizontally between said motor and said runner driver, wherein said confined space has a vertical dimension that is less than the sum of the vertical dimension of said motor, said runner driver, and said housing, but greater than the sum of the vertical dimensions of said first wrench and said housing.

2. The wrench assembly according to claim 1 wherein said housing is sized to allow said motor to remain external to said confined space when said runner driver is inserted into said confined space and operatively engages a threaded member.

3. The wrench assembly according to claim 1 wherein said housing is sized to sufficiently separate said runner driver from said motor to allow said runner driver to be inserted into said confined space and operatively engage a threaded member.

4. The wrench assembly according to claim 3 further comprising a motor driver operatively positioned between said motor and said runner driver.

5. The wrench assembly according to claim 4 further comprising a belt extending between said motor driver and said runner driver.

6. The wrench assembly according to claim 3 wherein said motor driver comprises a first pulley in rotational communication with said runner driver.

7. The wrench assembly according to claim 6 wherein said runner driver further comprises a second pulley in rotational communication with said first pulley.

8. The wrench assembly according to claim 6 wherein said runner driver further comprises a second pulley in rotational communication with said motor driver.

9. The wrench assembly according to claim 4 wherein said motor driver comprises a first pulley in rotational communication with said second pulley.

10. The wrench assembly according to claim 1 wherein said motor is a hydraulic motor, an air-driven motor, or an electric motor.

11. The wrench assembly according to claim 4 wherein said motor driver comprises a first gear and wherein said runner driver further comprises a second gear, said first gear and said second gear in rotational communication.

12. The wrench assembly according to claim 11 further comprising a chain extending between said first and second gears.

13. The wrench assembly according to claim 11 wherein said first and second gear have teeth, said teeth of said first gear operatively engageable with said teeth of said second gear so that the rotation of said first gear causes said second gear to rotate.

14. The wrench assembly according to claim 11 further comprising at least one spacer gear positioned between said first gear and said second gear, said spacer gear in rotational communication with said first and said second gears.

15. The wrench assembly according to claim 4 wherein said runner driver further comprises a detachable socket member operatively engageable with said drive head.

16. The wrench assembly according to claim 4 further comprising a adapter having a first end and a second end, said first end operatively engageable with a threaded member, said second end insertable through said drive head, said second end operatively engageable with said runner driver.

17. The wrench assembly according to claim 16 wherein said runner driver has a driver end operatively engageable with said second end of said adapter.

18. The wrench assembly according to claim 17 wherein said second end of said adapter has a drive bore configured therein to receive said driver end of said runner driver.

19. The wrench assembly according to claim 18 further comprising a retaining member engaged with said adapter.

20. A method of loosening a threaded member in a confined space comprising the steps of:

(a) providing a first non-manual wrench comprising at least a drive head operatively engageable with a threaded member;

(b) providing a second wrench operatively engageable with said drive head, said second wrench comprising:

(i) a motor;

(ii) a runner driver operatively engageable with said threaded member, said runner driver operatively connected to said motor, whereby said motor may rotate said threaded member; and (iii) a housing extending substantially horizontally between said motor and said runner driver, wherein said confined space has a vertical dimension that is less than the sum of the vertical dimension of said first wrench and said second wrench but greater than the vertical dimension of said drive head and said runner driver;

(c) operating said first wrench; and, (d) operating said second wrench.

21. The method according to claim 20 wherein said housing is sized to allow said motor to remain external to said confined space when said runner driver is inserted into said confined space and operatively engages a threaded member.

22. The method according to claim 20 wherein said housing is sized to sufficiently separate said runner driver from said motor to allow said runner driver to be inserted into said confined space and operatively engage a threaded member.

23. A method of tightening a threaded member in a confined space comprising the steps of:

(a) providing a first non-manual wrench comprising at least a drive head operatively engageable with a threaded member;

(b) providing a second wrench operatively engageable with said drive head, said second wrench comprising:

(i) a motor;

(ii) a runner driver operatively engageable with said threaded member, said runner driver operatively connected to said motor, whereby said motor may rotate said threaded member; and (iii) a housing extending substantially horizontally between said motor and said runner driver, wherein said confined space has a vertical dimension that is less than the sum of the vertical dimension of said first wrench and said second wrench but greater than the vertical dimension of said drive head and said runner driver;

(c) operating said second wrench; and, (d) operating said first wrench.

24. The method according to claim 23 wherein said housing is sized to allow said motor to remain external to said confined space when said runner driver is inserted into said confined space and operatively engages a threaded member.

25. A wrench assembly for loosening or tightening a threaded member in a confined space, comprising:

(a) a first wrench configured to engage and automatically rotate a threaded member; and (b) a second wrench comprising:

(i) a motor;

(ii) a runner driver configured to engage said threaded member, said runner driver operatively connected to said motor, whereby said runner driver and said threaded member may be rotated independently of said first wrench; and (iii) a housing extending substantially horizontally between said motor and said runner driver, wherein said confined space has a vertical dimension that is less than the sum of the vertical dimension of said motor, said runner driver, and said housing, but greater than the sun of the vertical dimensions of said first wrench and said housing.

* * * * *